US005079049A

United States Patent [19]

Kito et al.

[11] Patent Number: 5,079,049

[45] Date of Patent: Jan. 7, 1992

[54] ARTIFICIAL PLANT THAT STABLY EXHIBITS DIFFERENT COLORS

[75] Inventors: Tsutomu Kito, Gifu; Norikazu Nakasuji, Aichi; Hiroshi Inagaki, Aichi; Yutaka Shibahashi, Aichi; Takashi Kataoka, Aichi, all of Japan

[73] Assignee: The Pilot Ink Co., Ltd., Nagoya, Japan

[21] Appl. No.: 592,243

[22] Filed: Oct. 3, 1990

[30] Foreign Application Priority Data

Oct. 4, 1989 [JP] Japan ..... 1-116839[U]

[51] Int. Cl.[5] ..... A41G 1/00

[52] U.S. Cl. ..... 428/24; 428/321.5; 428/913

[58] Field of Search ..... 428/24, 26, 913; 503/200, 201, 204, 225

[56] References Cited

U.S. PATENT DOCUMENTS

| | | | |
|---|---|---|---|
| 1,592,148 | 7/1926 | Munn | 401/1 |
| 4,028,118 | 6/1977 | Nakasuji et al. | 106/21 |
| 4,176,273 | 11/1979 | Fujie | 219/220 |
| 4,720,301 | 1/1988 | Kito et al. | 106/21 |
| 4,725,462 | 2/1988 | Kimura | 428/29 |
| 4,818,215 | 4/1989 | Taga | 431/126 |
| 4,820,683 | 4/1989 | Vervacke et al. | 503/210 |
| 4,895,827 | 1/1990 | Vervacke et al. | 503/210 |
| 4,917,643 | 4/1990 | Hippely | 446/14 |
| 4,920,991 | 5/1990 | Shibahashi et al. | 132/73 |

FOREIGN PATENT DOCUMENTS

| | | | |
|---|---|---|---|
| 2205255 | 12/1988 | United Kingdom | 446/14 |

*Primary Examiner*—Bruce H. Hess

*Attorney, Agent, or Firm*—Fitzpatrick, Cella, Harper & Scinto

[57] ABSTRACT

An artificial plant having at least one section which bears a color memory dye of an electron-supplying organic coloring compound, an electron accepting compound an an ester. The color memory dye assumes a first color below t1 (° C.) and a second color above t2 (° C.), wherein $t2>t1$, $0 \leqq t1$, $t2 \leqq 50°$ C. and $5 \leqq t2-t1 \leqq 35$. Both the first and second colors can be displayed between t1 and t2.

21 Claims, 1 Drawing Sheet

ARTIFICIAL PLANT THAT STABLY EXHIBITS DIFFERENT COLORS

BACKGROUND OF THE INVENTION

1. Field of the Invention

This invention relates to artificial flora and in particular, to artificial flora which can arbitrarily assume a particular color display. The flora of the present invention can stably display one color, and then change the one color to another color which can also be stably displayed. A display state in which plural colors stably coexist can also be selected.

2. Brief Description of the Prior Art

There have previously been proposals relating to artificial flowers which exhibit color change in response to a temperature change in, for example, Japanese Utility Model Publication No. 7269/75 and Japanese Laid-Open (Kokai) Patent Application No. 6303/86. Such conventional artificial flowers change their color at a predetermined temperature from one color state existing at a normal temperature range to another color state existing outside (i.e., either above or below) that temperature range. However, when the heat (or chill) which is required to obtain the other color state is discontinued and the flower cools (or warms), the flower returns from the other color state to the first color state which appears in the normal temperature range. Thus, the prior art flowers merely provide enjoyable but temporary color change corresponding to the environmental, or local temperature surrounding the flower.

Accordingly, it would be desirable to produce a flower which can attain a second color which is stably retained after the temperature of the flower has returned to normal and the heat or chill is removed. It would also be desirable to produce a flower which can stably exhibit two or more colors simultaneously when the temperature of the flower has returned to normal after the heat or chill is removed.

BRIEF DESCRIPTION OF THE PRESENT INVENTION

It is an object of the present invention to provide artificial flora providing a display which can change from one stable color state to another.

It is another object of the present invention to provide artificial flora which can simultaneously exhibit at least two colors, at least one of which is changeable such that it is stably maintained both before and after changing.

These objects and others are provided by the present invention which is a novel artificial plant having at least one section, such as a stem, petal, nutlet or leaf of a color which can be changed upon the application of heat or chill. That section can have any arbitrarily selected color state both before and after the color has been changed. Additionally, since in the present invention both color can simultaneously exist, the flora can be made to exhibit various appearances within a predetermined temperature range such that the commercial desirability of the artificial plant is enhanced.

DETAILED DESCRIPTION OF THE PRESENT INVENTION

Figure 1:
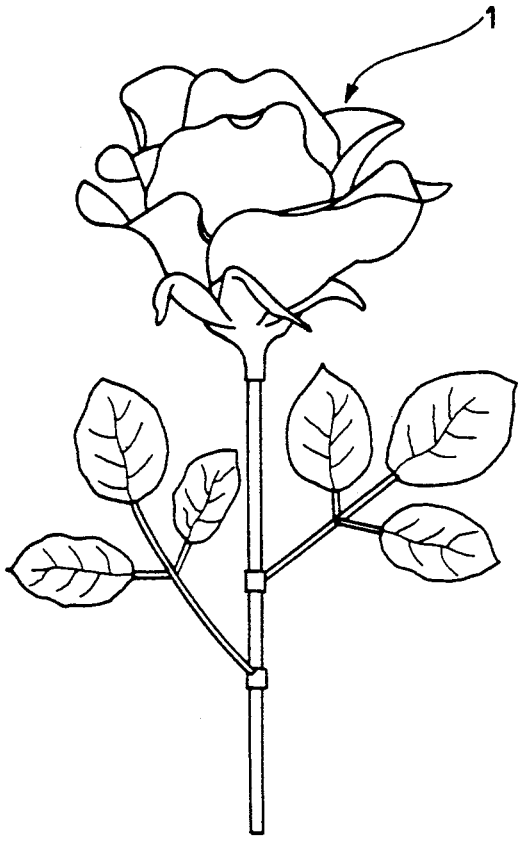
FIGS. 1 and 2 are perspective views of a preferred embodiment of a color memory artificial flower of the present invention.
Figure 2:
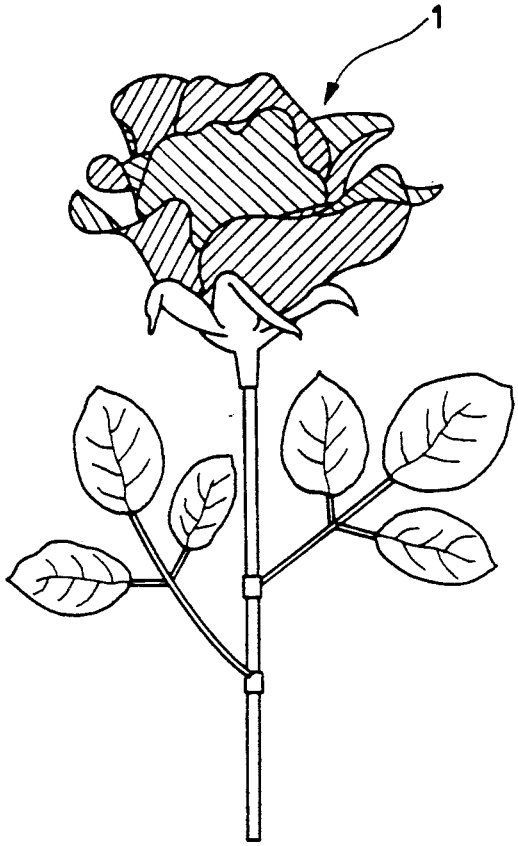
Figure 3:
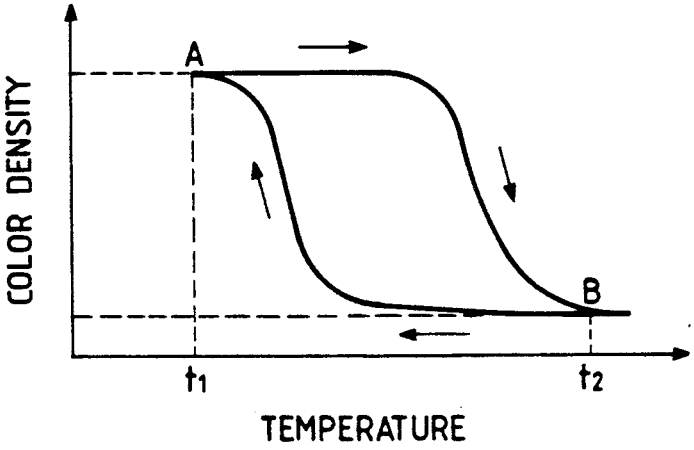
FIG. 3 is a graph showing a color changing condition of a color memory dye used in the present invention.

The present invention is described with reference to FIGS. 1 to 3 in which a flower 1 is specifically utilized for purposes of explanation. It will be appreciated, of course, that any other desired plant can be utilized as the artificial flora.

In the color memory artificial flower 1 according to the present invention, at least part of a surface of a petal 2, nutlet (not illustrated), stem 3 or leaf 4 is colored with a coloring material containing a color memory dye. The color memory dye reversibly changes color and exhibits a large hysteresis characteristic in response to a temperature change. The color memory dye comprises an electron-supplying organic coloring compound, an electron-accepting compound and an ester compound for causing the hysteresis characteristic.

Preferable electron-supplying organic coloring compounds are diaryl phthalides, indolyl phthalides, polyaryl carbinols, leuco auramines, acyl auramines, aryl auramines, rhodamine B lactams, indolines, spiropyrans and fluorans.

Preferable electron-accepting compounds are phenolic compounds, metal salts of the phenolic compounds, aromatic carboxylic acids, aliphatic carboxylic acids, metal salts of the acidic phosphoric esters, metal salts of the acidic phosphoric esters and triazole compounds.

Preferable ester compounds are alkyl esters, aryl esters and cycloalkyl esters of aromatic carboxylic acid having substituent(s) or not in the aromatic ring, branched alkyl esters, aryl esters, aryl alkyl esters and cycloalkyl esters of aliphatic carboxylic acid, alkyl esters of alicyclic carboxylic acid, diestels of dicarboxylic acid and glycerides.

The color memory dyes disclosed in U.S. Pat. No. 4,720,301 can be suitably used in the present invention. In this regard, British patent application publication No. 2,205,255 and copending U.S. patent application Ser. No. 476,941 (field Feb. 8, 1990), now U.S. Pat. No. 5,011,445, all relate to a toy using the color memory dyes. As used in this invention, the color memory dyes preferably provide a lower color-changing temperature t1 (°C.) and a higher color-changing temperature t2 (°C.) such that $t2>t1$, wherein the color memory dye displays a different color above t2 as compared to below t1. Also, as used in this invention, one of the color states below t1 or above t2 may be transparent. Color-changing temperatures t1 and t2 are selected to both be within the temperature range of 0° C. to 50° C., wherein $5 \leqq t2-t1 \leqq 35$.

Thus, applying a chill of less than t1 (°C.) (or a warming of more than t2 (°C.), a different color state can be attained if the previous color state was provided by a warming of more than t2 (°C.) (or a chill of less than t1 (°C.)). A state of coexistence of both colors can also be selected if the color changing portion of flower 1 is locally chilled or warmed. The thus selected color display state can be maintained stably within the temperature range of t1 to t2. Preferably, the lower color-changing temperature t1 (°C.) satisfies the requirement of $5 \leqq t1 \leqq 23$, and the higher color-changing temperature t2 (°C.) satisfies the requirement of $25 \leqq t2 \leqq 40$.

The hysteresis characteristic of the present invention is obtained from the shape of a curve obtained by plotting changes in color density according to changes in temperature. As shown in FIG. 3, in the present invention the curve obtained when the temperature increases from below t1 to above t2 differs from the curve obtained when it decreases from above t2 to below t1 so that a loop is formed when the two curves are combined. As used in the present invention, the temperature at point A (where the two curves join at the lower temperature side) is defined as t1 (°C.), i.e., the lower color-changing temperature and the temperature at point B (where the two curves join at the higher temperature side) is defined as t2 (°C.), i.e., the higher color-changing temperature.

Temperature t1 of the color memory dye can be attained, for example, from cold spray, the temperature within a refrigerator, cold water, ice, etc., and temperature t2 can be attained, for example, from a hair dryer, human body temperature, warm water and the like. Thus, since these temperatures are readily obtained throughout the human environment, attaining the necessary chilling and heating temperatures can easily be obtained.

The temperature range between t1 and t2 defines the dual-color maintaining temperature range in which both color states coexist stably. The present invention may also utilize plural color memory dyes with different hysteresis characteristics. Application of these dyes on the same or different surfaces of flower can reversibly provide a wide variety of patterns and designs. Preferably, in this instance, the hysteresis characteristic (i.e., t1 to t2 range) of one of the color memory dyes completely includes that of the other color memory dye (i.e., t1' to t2'), that is, it is desirable that $t1<t1'$ and $t2>t2'$. However, if one of the dyes assumes a colorless state, it is also acceptable if one of t1 to t2 (or t1' or t2') is within the range t1' to t2' (or t1 to t2).

The color memory dye is dispersed in a medium containing a binder, and can be provided in the form of a coloring material such as ink, pigment or paint, so that the surfaces of the materials forming the petals 2, nutlets or leaves 3 of the artificial flower 1 can be treated with the color memory dye by any suitable conventional method such as coating, spraying, printing and dipping. Generally, the surface is treated before the artificial flower 1 is assembled. Alternatively only desired portions of the artificial flower 1, such as the petals 2, nutlets and leaves 3, amy be colored after the flower 1 is assembled.

Of course, colors, patterns and the like may also be formed on the surface of the flower using conventional color materials or pigments before or after the color treatment of the present invention, thereby providing a wide variety of possible appearances due to color changes.

The binder may be conventionally-used binding agent such as natural or synthetic rubber sand waxes. The kind of the binder to be used is suitably selected depending on the material of the artificial flower 1. The materials of the petals 2, nutlets and leaf 3 constituting the flower 1, as well as means for forming the artificial flower, are those which are conventionally used.

In order to enhance the sensitivity and effectiveness of the color memory dye, it is desirable that the dye be placed within microcapsule having a particle size of from 0.5 to 50 μm, and more preferably from 1 to 30 μm, to form a microencapsulated pigment. The microencapsulated pigment preferably contains from 0.1 to 40 wt. % (preferably, from 0.2 to 25 wt. %) of the color memory dye and is fixed to the binder in a dispersed condition to form a color layer. Preferably, the content of the microencapsulated pigment in the color layer is from 5 to 80 wt. % (more preferably, from 10 to 60 wt. %) to obtain optional thermochromatic effects. Namely, if the content is less than 5 wt. %, the color density is so low that the change of color is not clearly seen. On the other hand, if the content exceeds 80 wt. %, a clear colorless state is difficult to attain. Similarly, the thickness of the color layer should be at least 0.5 μm, preferably from 1 to 400 μm, and more preferably 10 to 200 μm, so that satisfactory color change effects can be obtained within the above pigment content ranges. If the thickness is less than 0.5 μm, a clear color change is not obtained, while if the thickness exceeds 400 μm, the beauty of the appearance is damaged.

In order to enhance the glossiness, stain resistance and water resistance etc. of the present invention, a transparent resin film of an acrylic, a water-repellent or other transparent resin may be formed on the colored surface of the petal, nutlet or leaf. Also an ultraviolet-absorbing agent may be mixed in such resin to improve its resistance to fading in light.

When the color-changing portion of flower 1 (i.e., the stems 3, nutlets, petals 2 or leaves 4) are formed of a thermoplastic material, the color memory dye may be kneaded in the material before the molding, so that the flower can be molded of a molten material. Preferably, in this instance the pigment is microencapsulated. Such blending can also be suitably used in combination with another color memory dye system using, for example, the above-mentioned coating means.

When a portion of the artificial flower colored with the color memory dye which displays a single color state is cooled to below the temperature t1, the other color state is attained, if the first color state resulted from that portion being warmed above t2. The cooled portion can now be warmed to attain the normal temperature range of from t1 to t2, stably maintaining the other color state.

The surface of the portion in the other color state can now be brought into the first color state by heating that portion above the temperature t2. That portion can be maintained in the first color state simply by being returned to the normal temperature range. However, if the first color state resulted from being cooled below t1, the other color state is, of course, attained be warming that portion above t2. All the above changes can, of course, be reversed, as desired. Similarly, as stated above, the color states may overlap with color states of a second color memory dye, and at least one of the color states may be clear.

Thus, according to the artificial flower of the present invention, a user can readily select and maintain any desired on of at least two kilns of appearance. Moreover, by applying heat or chill, as desired, to only a part of the colored portion, only the appearance of that part is changed. Further, if the various portions of the surface are colored respectively with coloring materials having different kinds of color memory dyes, the overall pattern is changed each time each portion is changed.

The present invention is now described in further detail in the following actual embodiments.

EXAMPLE 1

A spray coating material was selected which contained both a color memory dye and an ordinary yellow pigment. The spray coating material was a dispersion comprising 8 parts by weight of color memory dye microcapsule (particle size: 5 to 10 μm), 50 parts by weight of an acrylic resin (xylenebutyl acetate type solvent; solid content: 50%); 0.5 parts by weight yellow pigment and 50 parts by weight of solvent (30 parts by weight of xylene and 20 parts by weight of toluene). The microcapsule were formed of 90 parts by weight % color memory dye and 10 parts by weight % epoxy-amine curing agent.

The spray coating material was sprayed onto surfaces of petals of a rose made of non-patterned white polyester cloth. The spray coat was dried so as to prepare a color memory artificial flower, the color memory dye being reversible between red and yellow (t1:10° C.; t2:32° C.) in response to temperature change.

Each petal of the artificial flower was warmed by the hands, such that the petals changed to assume a yellow appearance (shown in FIG. 1) at a room temperature of about 24° C. The artificial flower was then cooled by applying cold spray or placing it in a refrigerator, so the petals were changed to assume a red appearance, which was stably maintained in a temperature range of 15° C. to 30° C. The petals were able to reversibly exhibit the red and yellow color states and this reversibility was reproduced repeatedly.

EXAMPLE 2

A coating material containing a color memory dye was sprayed onto surfaces of petals of peony made of nonpatterned white polyester cloth, the color memory dye being capable of reversibly showing red and colorless states (t1:8° C.; t2:32° C.) in response to temperature change. Additionally, a coating material containing a temperature-sensitive dye was similarly coated onto the leaves made of patterned polyester cloth having a spotted pattern printed with green, non-color-changing ink. The temperature-sensitive dye which was printed on the leaves is reversible between green and colorless state (t1:8° C.; t2:32° C.). In this manner, an artificial peony was prepared.

The coating liquid which was used was a dispersion comprising 10 parts by weight of color memory dye was microcapsule (particle size: 5 to 10 μm), 20 parts by weight of acrylic ester-type emulsion (solid content: about 60%), and 70 parts by weight of water containing 0.1 part by weight of an anti-roaming agent. The microcapsule were formed by interfacial poly-merization using an epoxy resin-amine curing agent system.

When the petals and leaves were heated using a hair dryer to a room temperature of about 20° C., the petals changed to white, and the leaves changed to the spotted pattern. Then, when the artificial flower was cooled by putting it in a refrigerator, the petals were changed to red, and the leaves were changed to green (i.e., the spotted pattern disappeared). These appearances were stably maintained in a temperature range of 15° C. to 30° C. When artificial flower was again heated by a hair dryer, the petals were changed to white, and also the leaves were changed to the spotted green pattern. The changes of the appearances according to the above procedure could be reproduced repeatedly.

EXAMPLE 3

A spray coating material was formulated which contained 99 parts by weight of a transparent resin solution (80 wt. % toluene-ethyl acetate solvent; 20 wt. % acrylic resin) and 1 part by weight of an ultraviolet-absorbing agent (Tinuvin 327: trade name, CIBA-GEIGY Co., Ltd., the component of which is 2-(3'5'-di-tert-butyl-2'-hydroxy-phenyl)-5-chlorobenzotriazole) was sprayed on the surfaces of the petals of the reversible red/yellow rose of obtained in Example 1. The artificial flower was then dried. Thereafter, the petals exhibited improved glass as compared with the untreated ones of Example 1. After the artificial flower was left near a window in the sunlight for a long period of time, neither contamination of the petal surface or deterioration due to light were noticeable.

When the treated petals were warmed by the hands or cooled by cold spray, the same color changes and color reversibility characteristics shown in Example 1 were obtained.

As described above, in the artificial flower of the present invention, some or all of the petals, nutlets or leaves can stably changed their color simply by being heated or chilled. Any one of (i) the color before the color changing, (ii) the color after the color changing, or (iii) the state of coexistence of both colors can be arbitrarily selected, and the selected color state can thus be stably maintained throughout the normal temperature range. Accordingly, a variety of appearances can be enjoyed using a single artificial plant.

It will be appreciated that various modifications of the present invention are within the purview of those skilled in the art and those modifications and the like are intended to be covered by the following claims.

What is claimed is:

1. An artificial plant, at least one section thereof bearing a color memory dye having a hysteresis characteristic, said color memory dye comprising an electron-supplying organic coloring compound, an electron accepting compound and an ester for causing the hysteresis characteristic, and said color memory dye assuming a first color below t1 (°C.) and a second color above t2 (°C.), wherein $t2>t1$, $0\leqq t1$, $t2\leqq 50°$ C. and $5\leqq t2-t1\leqq 35$, both of said first and second colors capable of being displayed between t1 and t2.

2. The artificial plant of claim 1, wherein $5\leqq t1\leqq 23$.

3. The artificial plant of claims 1 or 2, wherein $25\leqq t2\leqq 40$.

4. The artificial plant of claim 3, wherein the color memory dye is dispersed in a binder.

5. The artificial plant of claim 4, wherein the dispersed color memory dye is microencapsulated.

6. The artificial plant of claim 5, wherein the color memory dye microcapsule have a particle size of from 0.5 to 50 μm.

7. The artificial plant of claim 6, wherein the color memory dye microcapsule contain from 0.1 to 40 weight % color memory dye.

8. The artificial plant of claim 7, wherein the color memory dye microcapsule have a particle size of from 1 to 30 μm.

9. The artificial plant of claim 8, wherein the color memory dye microcapsule contain from 0.2 to 25 weight % color memory dye.

10. The artificial plant of claim 5, wherein the color memory dye is dispersed in the binder at from 10 to 60 weight %.

11. The artificial plant of claim 4, wherein the color memory dye is dispersed in the binder at from 5 to 80 weight %.

12. The artificial plant of claim 4, wherein said section of artificial plant bearing said color memory dye is coated with a color memory dye layer of at least 0.5 μm thickness.

13. The artificial plant of claim 12, wherein said section of artificial plant bearing said color memory dye is coated with a color memory dye layer of from 1 to 400 μm thickness.

14. The artificial plant of claim 13, wherein said section of artificial plant bearing said color memory dye is coated with a color memory dye layer of from 10 to 200 μm thickness.

15. The artificial plant of claim 12, wherein said color memory dye layer is coated with a transparent resin.

16. The artificial plant of claim 15, wherein said transparent resin contains an ultraviolet light-absorbing agent.

17. The artificial plant of claim 3, wherein said section of artificial plant bearing said color memory dye is a thermoplastic material and a pigment is admixed into said thermoplastic material.

18. The artificial plant of claim 17, wherein said color memory dye is microencapsulated.

19. The artificial plant of claim 3, wherein said artificial plant comprises a second color memory dye which assumes third and fourth colors.

20. The artificial plant of claim 19, wherein one of said first, second, third or fourth colors is clear.

21. The artificial plant of claim 1, wherein one of said first and second colors is clear.

* * * * *

UNITED STATES PATENT AND TRADEMARK OFFICE

CERTIFICATE OF CORRECTION

PATENT NO. : 5,079,049

DATED : January 7, 1992

INVENTOR(S) : TSUTOMU KITO ET AL.

It is certified that error appears in the above-identified patent and that said Letters Patent is hereby corrected as shown below:

On the Title page, item [57] ABSTRACT

Line 4, "an" (first occurrence) should read --and--.

COLUMN 2

Line 42, "(field" should read --(filed--.

COLUMN 3

Line 46, "amy" should read --may--.
Line 55, "rubber sand" should read --rubbers and--.

COLUMN 4

Line 46, "be" should read --by--.
Line 54, "on" should read one-- and
"kilns" should read --kinds--.

COLUMN 5

Line 47, "poly-merization" should read --polymerization--.

UNITED STATES PATENT AND TRADEMARK OFFICE

CERTIFICATE OF CORRECTION

PATENT NO. : 5,079,049

DATED : January 7, 1992

INVENTOR(S) : TSUTOMU KITO ET AL.

It is certified that error appears in the above-identified patent and that said Letters Patent is hereby corrected as shown below:

COLUMN 6

Line 17, "changed" should read --change--.

Signed and Sealed this

Twenty-fifth Day of May, 1993

Attest:

Michael K. Kirk

MICHAEL K. KIRK

Attesting Officer

Acting Commissioner of Patents and Trademarks